United States Patent [19]

van Esdonk et al.

[11] Patent Number: 4,806,818

[45] Date of Patent: Feb. 21, 1989

[54] METHOD OF PROVIDING ELECTRICAL CONTACT TO A SEMICONDUCTOR CATHODE, CATHODE SO PRODUCED, AND ELECTRON TUBE PROVIDED WITH SUCH CATHODE

[75] Inventors: Johannes van Esdonk; Jacobus Stoffels; Petrus J. M. Peters, all of Eindhoven, Netherlands

[73] Assignee: U.S. Philips Corporation, New York, N.Y.

[21] Appl. No.: 95,694

[22] Filed: Sep. 14, 1987

[30] Foreign Application Priority Data

Sep. 15, 1986 [NL] Netherlands ..... 8602330

[51] Int. Cl.[4] ..... H01J 9/02

[52] U.S. Cl. ..... 313/346 R; 437/182; 437/916; 437/357; 437/30

[58] Field of Search ..... 313/346 R, 446; 357/30 Q; 445/35-36; 437/916, 182

[56] References Cited

U.S. PATENT DOCUMENTS 4,286,373 9/1981 Gutierrez et al. ..... 437/916 X 4,717,855 1/1988 Zwier et al. ..... 313/346 R

*Primary Examiner*—Kenneth J. Ramsey

*Attorney, Agent, or Firm*—John C. Fox

[57] ABSTRACT

A contact for a semiconductor cathode is produced by thermally bonding leads consisting of one of the metals Ag, Au, Cu and one of the metals Ta, Ti, V. Such a contact does not exhibit degradation when the cathode, after mounting in a vacuum tube, is heated several times to approximately 850° C. for cleaning purposes.

11 Claims, 1 Drawing Sheet

METHOD OF PROVIDING ELECTRICAL CONTACT TO A SEMICONDUCTOR CATHODE, CATHODE SO PRODUCED, AND ELECTRON TUBE PROVIDED WITH SUCH CATHODE

BACKGROUND OF THE INVENTION

The invention relates to a method of providing electrical contact to a semiconductor cathode having a surface zone of a first conductivity type in a semiconductor region at least partially surrounding the surface zone, and also relates to a semiconductor cathode produced thereby and to an electron tube produced incorporating it.

More particularly, the invention relates to such a method of providing electrical contact which results in contacts able to withstand subsequent thermal processing of an electron tube incorporating the contacted semiconductor cathode.

The method according to the invention is particularly but not exclusively suitable for semiconductor cathodes of the type commonly referred to as reverse biased junction cathodes as described, inter alia, in Netherlands Patent Application No. 7905470 in the name of the Applicant.

As described in the Patent Application, the emitting surface of the cathode is coated with a layer of a material which decreases the electron work function, preferably a mono-atomic layer of pure caesium, in order to obtain a satisfactory efficiency.

To this end the emitting surface must be cleaned in advance. This cleaning operation, which is also desirable when the layer of material decreasing the work function is not provided, is carried out after it has been mounted in the electron tube and after evacuation of the electron tube by heating the semiconductor cathode to a temperature which is sufficiently high (approximately 850° C.) to remove all unwanted elements from the emitting surface.

This heating temperature is generally so high that contacts conventionally used in semiconductor technology such as, for example, aluminium, gold and silver contacts, provided by means of soldering, ultrasonic bonding or thermocompression bonding, are not resistant thereto, inter alia, because eutectic alloys or (in silicon cathodes) silicides are produced or material is attacked by melting or evaporation, leading for example, to short circuits between this zone and the surrounding semiconductor region.

Such problems notably occur if the depth of the surface zone is approximately 5 μm or less.

When using contacts of materials melting at higher temperatures such as, for example, tantalum, provided by means of laser welding, such problems do not occur but the weld may become unreliable due to crack formation.

SUMMARY OF THE INVENTION

A method according to the invention in which the above problems are substantially avoided is characterized in that the surface zone is provided with electrical contact to a lead comprising at least one layer of a first metal from the group of tantalum, titanium and vanadium, and one layer of a second metal from the group of gold, silver and copper, and in that the contact is obtained by means of a thermal treatment.

As used herein, thermal treatment is understood to mean bonding techniques conventionally carried out at elevated temperatures such as, for example, thermocompression bonding, resistance welding, laser welding, etc.

A preferred embodiment of the invention is characterized in that the layer of the second metal is in direct contact with on the semiconductor surface and has a thickness of up to about 0.25 times the depth of the surface zone of the first conductivity type.

A semiconductor cathode obtained by means of this method can be heated to temperatures of between 800° and 950° C., for example, after mounting in an electron tube, without the danger of a short-circuit occurring because the thickness of the second metal layer is so thin that the formation of possible eutectic compounds and/or silicides is limited to a thin upper layer of the surface zone of the first conductivity type. In practice it is found that such contacts to silicon semiconductor cathodes remain intact without any appreciable degradation, even in the case of heating several times to temperatures which are far above the eutectic temperature of silicon and the second metal.

Particularly, the combination of tantalum and silver was found to yield very stable contacts, notably if they were provided by means of thermocompression.

The cathode contacts obtained by this method are thus suitable to be introduced into an electron tube, which is heated to a temperature of between 800° C. and 950° C. after the semiconductor cathode has been mounted and sealed in the electron tube in order to clean the surface of the semiconductor.

The semiconductor surface cleaned by means of this thermal treatment has a substantially uniform emission behaviour. In addition a material decreasing the work function of the surface, preferably a mono-atomic layer of caesium, can be precipitated without any difficulty on such a clean surface.

BRIEF DESCRIPTION OF THE DRAWINGS

The invention will now be described in greater detail with reference to an embodiment and the drawing in which.

DESCRIPTION OF THE PREFERRED EMBODIMENT

Figure 1:
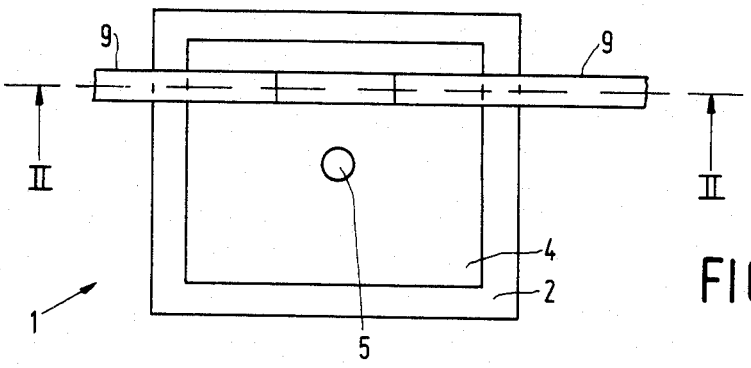
FIG. 1 is a diagrammatic plan view of a semiconductor cathode provided with a contact according to the invention.

The semiconductor cathode 1 (FIGS. 1, 2) has a p-type substrate 2 of silicon with an n-type zone 4 having a depth of approximately 5 micrometers on a surface 3. This semiconductor cathode is of the type commonly referred to as a "reverse biased junction" type. For a detailed description of the operation of such a semiconductor cathode reference is made to the above-cited Netherlands Patent Application No. 7905470.

The actual electron-emitting region is represented by the circular emission region 5 in FIG. 1, the surface of which can be coated with a mono-atomic layer of caesium in order to increase the emission efficiency. This layer of caesium is provided after the cathode is mounted on the end wall 7 of the electron tube 6 (FIG. 3) and the electron tube 6 is evacuated.

Before the layer of caesium can be provided, the surface 3 must first be cleaned at the area of the emitting region 5; this is effected by heating the cathode 1 to approximately 850° C., for example, by means of a heating resistor.

The connection wires 9 are manufactured according to the invention from a first layer 10 of tantalum which melts at a high temperature and a second layer 11 of silver which melts at a much lower temperature, the silver layer in this embodiment having a thickness of approximately 1 micrometer. Since this layer is thin with respect to the depth of the surface zone 4, a contact is obtained which is found to be satisfactorily resistant to the high temperatures used in subsequent steps for manufacturing the electron tube, notably cleaning of the emitting surface.

The silver-tantalum connection wires 9 are obtained by precipitating a thin layer of silver on a tantalum foil and then forming the connection wires or tapes from the foil by means of cutting. The double layer of silver-tantalum is subsequently secured to the surface 3 at the area of the semiconductor zone 4 by means of thermocompression bonding.

The connection wires 9 are passed outwards through lead-throughs in the end wall 7, as is a connection wire 12 for contacting the substrate 2. After the cathode is thus secured, the tube 6 is vacuum-exhausted or filled with an inert gas and subsequently sealed.

Figure 2:
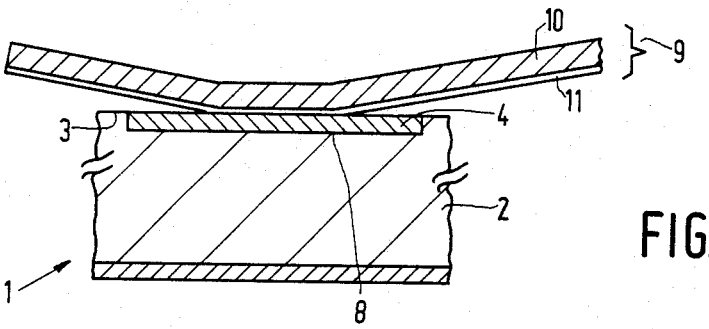
FIG. 2 is a diagrammatic cross-section view taken on the line II—II in FIG. 1.

Subsequently the cathode is heated to approximately 850° C. by means of a heating resistor for cleaning the emitting surface. Due to the small thickness of the silver layer 11 with respect to that of the n-type zone 4 there is no degradation of the pn-junction 8 (FIG. 2).

Finally a mono-atomic layer of caesium is provided in a conventional manner on the emitting surface from a caesium reservoir, not shown.

Figure 3:
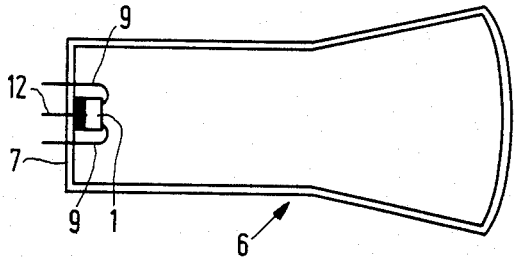
FIG. 3 diagrammatically shows an electron tube manufactured by means of a method according to the invention.

Other elements of the electron tube 6 such as, for example, deflection units etc. are also omitted from FIG. 3.

The invention is of course not limited to the embodiment shown, but several variations within the scope of the invention are contemplated.

For example, a layer of tantalum of approximately 0.2 μm may be provided in advance on the surface 3, which layer covers the underlying semiconductor body. In that case the silver layer 11 may have a larger thickness.

Although the embodiment refers to a pn-junction 9, a pin structure may alternatively be used.

In addition the surface 3 may be provided with an insulating layer on which acceleration electrodes may be provided, if necessary, around the emitting region 5, as described in the Netherlands Patent Application No. 7905470.

What is claimed is:

1. A method of providing electrical leads for a semiconductor cathode having a surface zone of a first conductivity type in a semiconductor region at least partially surrounding the surface zone, the method comprising providing electrical contact between the surface zone and the leads, characterized in that the leads comprise at least one layer of a first metal from the group of tantalum, titanium, and vanadium and one layer of a second metal from the group of gold, silver, and copper, and further characterized in that the contact is obtained by means of a thermal treatment.

2. A method as claimed in claim 1, in which the layer of the second material contacts the semiconductor surface and has a thickness of up to about 0.25 times the depth of the surface zone of the first conductivity type.

3. A method as claimed in claim 1, in which the first metal is tantalum and the second metal is silver.

4. A method as claimed in claim 1, in which the thermal treatment consists of thermocompression bonding.

5. A method as claimed in claim 1, in which the thermal treatment consists of laser welding.

6. A method as claimed in claim 1, in which the semiconductor material is silicon.

7. A semiconductor cathode produced by the method of claim 11.

8. A method as claimed in claim 1, in which the semiconductor cathode is sealed in an electron tube and heated to a temperature of between 800° C. and 950° C. after sealing.

9. A method as claimed in claim 8, in which the surface of the semiconductor cathode is coated with an electron work function decreasing material.

10. A method as claimed in claim 9, in which the material is a mono-atomic layer of caesium.

11. An electron tube produced by the method of claim 8.

* * * * *